US005145417A

United States Patent [19]

Honkomp et al.

[11] Patent Number: 5,145,417

[45] Date of Patent: Sep. 8, 1992

[54] TERMINAL BLOCK ASSEMBLY FOR HERMETIC TERMINAL STRUCTURE

[75] Inventors: Glenn A. Honkomp, Warren County; Thomas O. McNay, Clermont County; Larry G. Burrows, Hamilton County, all of Ohio; H. Howard Heimbrock, Dearborn County, Ind.

[73] Assignee: Emerson Electric Co., St. Louis, Mo.

[21] Appl. No.: 633,323

[22] Filed: Dec. 24, 1990

Related U.S. Application Data

[63] Continuation-in-part of Ser. No. 503,232, Apr. 2, 1990, Pat. No. 5,035,653.

[51] Int. Cl.[5] ..... H01R 21/08

[52] U.S. Cl. ..... 439/685; 439/926

[58] Field of Search ..... 439/397, 507, 512, 678, 439/685-686, 721, 736, 526, 935, 595

[56] References Cited

U.S. PATENT DOCUMENTS 3,932,013 1/1976 Yeager et al. ..... 439/510
4,368,939 1/1983 Foederer ..... 439/595 X
4,527,857 7/1985 Hughes et al. ..... 439/397 X
4,607,899 8/1986 Romine et al. ..... 439/512
4,753,607 6/1988 Heimbrock ..... 439/685 X

FOREIGN PATENT DOCUMENTS 0307580 3/1989 European Pat. Off. ..... 439/507

*Primary Examiner*—Eugene F. Desmond
*Attorney, Agent, or Firm*—Polster, Lieder, Woodruff & Lucchesi

[57] ABSTRACT

In combination with at least two terminal assemblies each having body members sealed in the housing wall of a hermetically sealed compressor with outer pin segments extending therefrom, two terminal blocks engageably connected to each of the body members to electrically engage the outer pin segments of the terminal assemblies and a power lead block arrangement interconnectable with one of the terminal blocks to electrically connect the two terminal blocks to a power source.

51 Claims, 8 Drawing Sheets

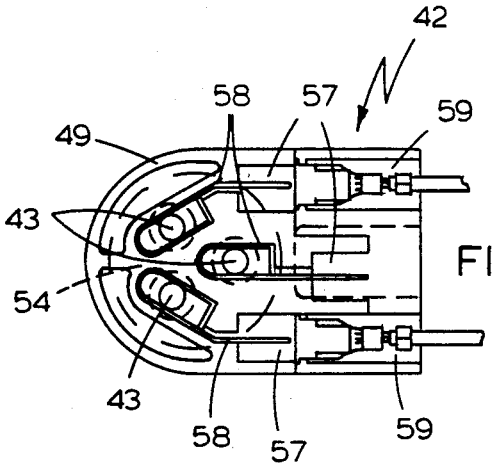
FIG. 8
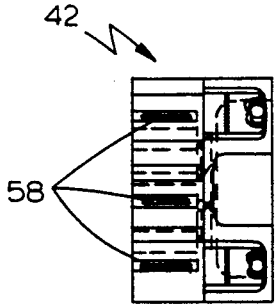
FIG. 10
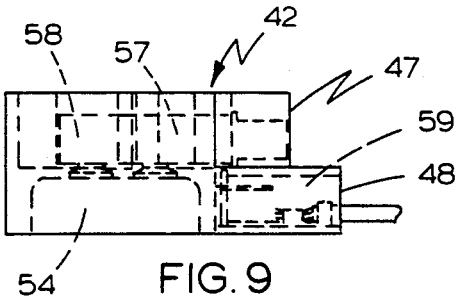
FIG. 9
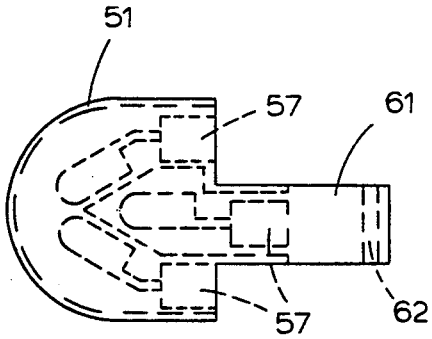
FIG. 11
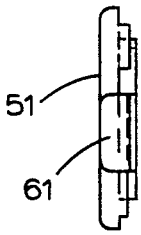
FIG. 13
FIG. 12
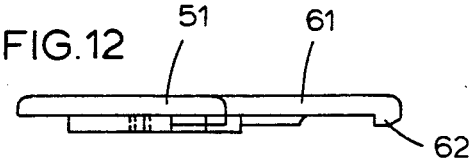

TERMINAL BLOCK ASSEMBLY FOR HERMETIC TERMINAL STRUCTURE

This invention constitutes a continuation-in-part of parent U.S. patent application Ser. No. 07/503,232, filed Apr. 2, 1990, now U.S. Pat. No. 5,035,653, issued Jul. 30, 1991, and as such, even more particularly relates to an improved terminal block assembly for hermetic terminal structure for a sealed housing, the novel terminal block assembly including at least one terminal block and a power lead block inter-connected therewith.

BACKGROUND OF THE INVENTION

The present invention relates to hermetic terminal assemblies and more particularly to an improved terminal block assembly for hermetic terminal structure.

It is known in the art of hermetic terminal assemblies to employ a current carrying electrically connected terminal pin, which pin incorporates a reduced fuse-like area generally located on the inner segment of the pin on the inner dish side face of a cup-shaped body of the terminal assembly. The cup-shaped body, in turn, is mounted in sealed relation on a housing wall with the inner segment of the pin being confined therein. It also is known in the art, to include a stop flange between the extremity of the inner segment of the pin and such fuse-like area within the cup-shaped body in the event such fuse-like area should melt because of abnormally excessive current conditions. In this regard, attention is directed to U.S. Pat. Nos. 4,584,433 issued to Benjamin Bowsky et al. on Apr. 22, 1986; No. 4,609,774 issued to David M. LeMieux et al. on Sep. 2, 1986; and, to No. 4,739,551, issued to Benjamin Bowsky et al. on Apr. 26, 1988, each of which patents broadly teaches the utilization of a fuse-like area incorporated as part of an inner segment of a pin and a flange member associated therewith. In addition, attention is directed to U.S. Pat. No. 4,461,925, issued to Benjamin Bowsky et al. on Jul. 24, 1984, which patent teaches a terminal pin having a stop flange associated therewith and which further includes a reduced area positioned immediately adjacent the outside area of the seal and cup-shaped body with no mention being made in this patent of a fuse guard and lead wire securing arrangement. Moreover, attention is directed to U.S. Pat. No. 3,160,460, issued to A. Wyzenbeek on Dec. 8, 1964 which broadly suggests a terminal block arrangement for a terminal assembly which guards an outer pin segment but which does not include or suggest a fuse incorporation remote from the outer pin segment, protection against terminal assembly leakage or sealing of the terminal block to the housing wall. Finally, attention is directed to U.S. Pat. Nos. 3,566,341, issued to S. J. Skony on Feb. 23, 1971 and No. 3,853,388, issued to H. Howard Heimbrock on Dec. 10, 1974, both of which patents teach looped end electrical connectors disposed in a block or housing assembly.

In accordance with the present invention, it is recognized that, as suggested in the earlier Bowsky et al. U.S. Pat. No. 4,461,925, it is desirable to locate the fuse-like area adjacent the outer face of the cup-shaped body of a terminal assembly to keep abnormally excessive currents from reaching and melting the glass which serves to form a seal between the pin and cup-shaped body of the terminal assembly. Such a desirable relative location of the fuse-like area of the pin of the terminal assembly outside the cup-shaped body not only has not been utilized in the more recent past, but, as is reflected in the structure disclosed in the aforementioned later issued patents to Bowsky et al., namely U.S. Pat. Nos. 4,584,433 and 4,739,551, the fuse-like area incorporated in the pin has been located on the inner segment of the terminal assembly pin, usually between a comparatively costly to manufacture stop-flange and the extremity of the inner segment of the pin, notwithstanding such glass melting problems. The present invention, recognizing the desirability of the location for the fuse-like area on the outer face or outside of the terminal assembly and further recognizing the reason for avoiding such selection in the recent past, provides a novel structure which obviates these now recognized problems, the present invention including the utilization of a novel, terminal block arrangement for covering the exposed outer segment of a pin such means functioning like a terminal block and further serving as a pin restraint during normal operations to avoid usage of the comparatively costly and more difficult to assemble stop-flange on the inner segment of the terminal pin and the cumbersome and comparatively difficult to assemble outer pin segment guard assemblies mounted on outer housing walls in past arrangements. In addition, the present novel terminal block arrangement provides a unique current resistive guard and wire securing arrangement for the outer segment of the pin means and wire connections of a terminal assembly which includes a protected fuse area therein, which in the event of fuse melt, serves to hold the lead wire ends in position to help prevent free floating of electrically alive wires. Further, the present invention, not only provides a novel, comparatively inexpensive to manufacture and assemble current resistive, integral guard assembly for the external segments of otherwise exposed outer pin segments of a terminal assembly, but also provides a novel means for readily mounting such integral guard assembly allowing the same to be bonded or fastened firmly in place to restrict ready access thereto, thus helping to minimize some of the safety problems which can arise through amateur repair attempts.

Moreover, the present invention of this continuation-in-part application includes a novel terminal block assembly which can be readily and economically manufactured and electrically connected together with a minimum of steps even further minimizing some of the safety problems which can arise through a mateur or unskilled repair attempts. Further the present invention allows for the ready electrical connection and disconnection of at least two terminal blocks to an appropriate source through a common power lead block, with location of fuse protection devices optionally in structure other than in the terminal and power lead blocks.

Various other features of the present invention will become obvious to one skilled in the art upon reading the disclosure set forth herein.

SUMMARY OF THE INVENTION

More particularly, the present invention provides in combination with a hermetic terminal assembly having a body member sealed in a housing wall with protruding outer pin segment means extending from the body member externally of the housing wall, a current resistive terminal block, the terminal block including a main channel having an aperture therein sized to engagingly receive and protect the outer pin segment means within the main channel means and to act as a diffuser in the event of terminal assembly leakage, the main channel means having subchannel means communicatively extending therefrom to accommodate outside lead wire end connection means including protected fuse means to be fastened to the outer pin segment means. In addition, the present invention provides a unique arrangement for the subchannel means including a plurality of elongated subchannels with the subchannels arranged in stacked communicatively connected segments to allow the fuse to be included in the lead wire end connection for each stacked subchannel so as to be located at a position remote from the main channel and the protected outer pin segment therein in the event of arcing upon the possible occasion of fuse melt.

Further, the present invention provides in combination with a hermetic terminal assembly having a body member sealed in a housing wall with protruding outer pin segment means sealed to the body member and extending from the body member externally of the housing wall, a current and heat resistive terminal block, the terminal block including main channel means having aperture opening means on one face of the block sized to engagingly receive and protect the outer pin segment means within the main channel means to act as a diffuser in the event of terminal assembly leakage, the main channel means having spaced subchannel means communicatively extending therefrom sized to accommodate internal power lead wire connector means nestingly fastenable at one end to the outer pin segment means and having one part of male-female electrical connections at the opposite end; a current and heat resistive power lead block having spaced channels alignable and cooperable with the spaced subchannel means of the terminal block, the spaced channel means of the power lead block being sized to accommodate electrical connector means the electrical connector means having the other part of male-female electrical connections at one end thereof nestingly engageable with the part of the male-female electrical connections at the end of the power lead means terminal block; and a set of outside lead wire means electrically connected at one end to the other end of the first electrical connector means of the power lead block and at the other end to a preselected power source. Even further, the present invention provides a second terminal block with a number of features like the previously described terminal block with the aforedescribed power lead block being readily interconnectible and disconnectible therewith to connect the second terminal block to a power source, the second terminal block assembly including utilization of a novel electrical U-shaped connector.

It is to be understood that various changes can be made by one skilled in the art in one or more of the several parts of the apparatus disclosed herein without departing from the scope or spirit of the present invention. For example, the main channel accommodating the outer pin segments could be centrally disposed with communicating spaced subchannels extending outwardly in radial arcs therefrom.

BRIEF DESCRIPTION OF THE DRAWINGS

Referring to the drawings which disclose one advantageous embodiment of the present invention and modified embodiments thereof:

FIGS. 8–10 and 11–13 are somewhat reduced top, side and end views respectively of the terminal body and cover therefore of FIG. 6 and 7, also disclosing in FIG. 8 the outside lead set connection through the lower tier of the first terminal block;

DETAILED DESCRIPTION OF THE DRAWINGS

Figure 1:
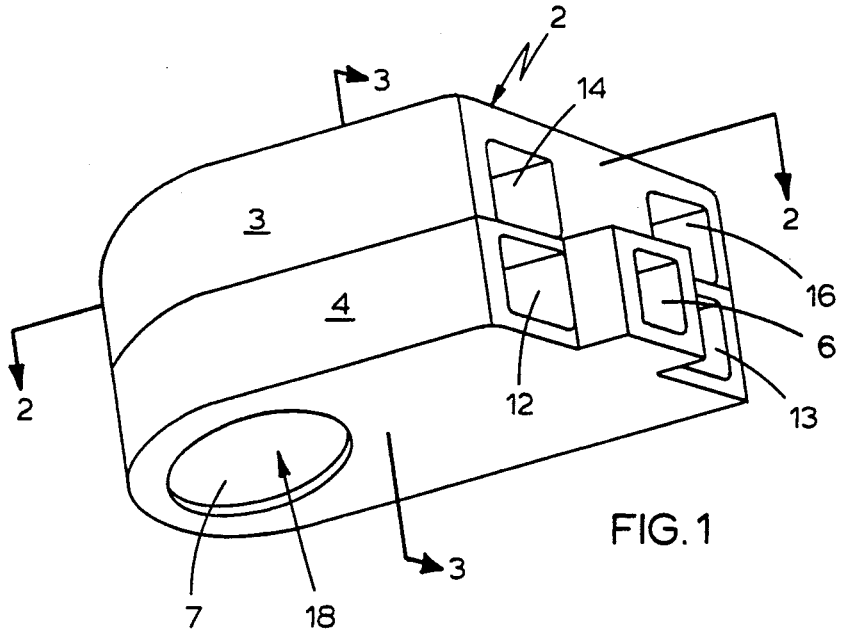
FIG. 1 is an isometric view of the inventive terminal block looking upwardly toward the bottom face thereof.
Figure 3:
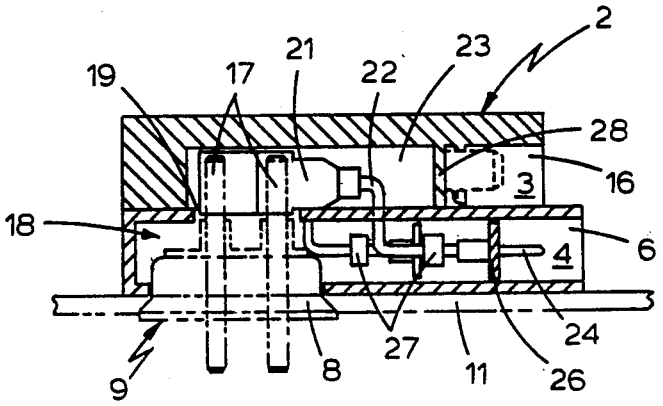
FIG. 3 is a cross-sectional view taken in a plane through line 3—3 of FIG. 2 of the terminal block of FIG. 2 bonded to a housing wall and the hermetic terminal assembly sealed in the housing wall projecting into the block.

Referring to FIG. 1 of the drawings, an advantageous embodiment of an inventive terminal block 2 is disclosed as including stacked upper block segment 3 and lower block segment 4. The upper and lower segments 3 and 4 can be made from any one of a number of appropriately specified current resistive materials, such as a suitable General Electric Company Noral SE1 plastic or an equivalent plastic material. The geometric conformation of the terminal block 2 can also vary in accordance with the hermetic terminal assembly and housing to which it is to be mounted. In the instant embodiment, the upper and lower segments 3 and 4 which are bonded to each other are similar in geometric confirmation with the exception that the lower segment 4 is provided with an open-ended extension 6 and an aperture 7 in the lower or under face thereof sized to nestingly receive a portion including the base and part of the skirt or rim of a cup-shaped body member 8 of a hermetic terminal assembly 9 which assembly 9 is sealed in the wall 11 of a hermtically sealed housing such as the outer wall of a compressor (FIG. 3). In addition to open-ended extension 6 in lower segment 4, each segment 3 and 4 can be provided at one side end thereof with a set of spaced openings, the lower segment 4 having spaced openings 12 and 13 on either side of open-ended extension 6, all three of such openings serving as passages for lead wire end connections to be described hereinafter. The upper segment 3 is shown as provided with two spaced openings 14 and 16 for insertion and connection of auxiliary wiring, also to be described hereinafter. It is to be understood that stacked upper and lower block segments 3 and 4 can be bonded together at their abutting faces by any one of a number of suitable adhesive materials or that it would even be possible to form the stacked, two-tiered terminal block as an integral unit rather than in two bonded parts.

Figure 2:
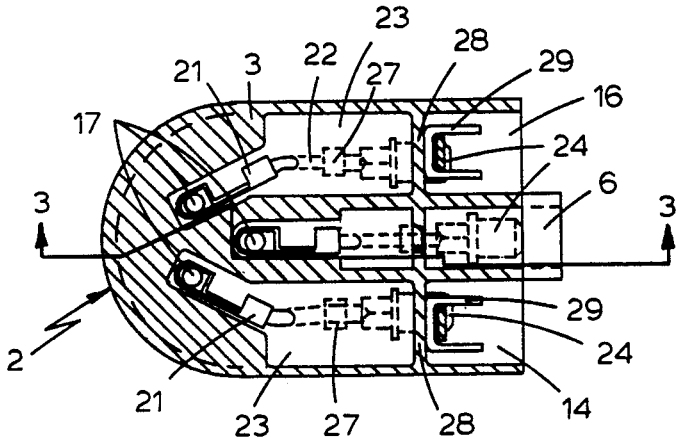
FIG. 2 is a somewhat reduced cross-sectional view taken in a plane through line 2—2 of FIG. 1 of the terminal block in engagement with the outer pin segments of a hermetic terminal assembly and showing in broken lines the lead wire end connections in the lower segment of the terminal block.

Referring to FIGS. 2 and 3 of the drawings, it can be seen that hermetic terminal assembly 9 sealed to housing wall 11 includes three (3) spaced outer pin segments 17 extending from the cup-shaped body member 8 along a main channel 18 which extends through lower block segment 4 of terminal block 2 into upper block segment 3 of terminal block 2, an aperture 19 communicatively connecting upper and lower segments 3 and 4 being sized to allow free passage of outer pin segments 17 into upper segment 3. The end portions of pin segments 17 each engage in a contact loop of an electrical end connector 21 which forms part of an electrical lead wire connection 22. Each electrical lead wire end connection 22 is encased in one of three spaced subchannels 23 which extend in lateral fashion from main channel 18. It is to be noted that each subchannel 23 includes an upper subchannel segment located in the upper block segment 3 of terminal block 2 and a lower subchannel segment located immediately below the upper segment in the lower block segment 4 of terminal block 2 so that three pairs, each comprised of stacked upper and lower subchannel segments are provided in terminal block 2 to encase three lead wire end connections 22 in extended Z-fashion with the lead wire end connections 22 passing through appropriate apertures in the wall between corresponding upper and lower subchannel segments. One end of each lead wire end connection 22 is connected to an outer pin segment 17 by looped end connector 21. The other end of each of the lead wires is provided with an electrical contact tab 24 fixed firmly in position by a crosswall 26 adjacent each of the openings 6, 12 or 13 and to which the lower subchannels segments of subchannels 23 extend. In accordance with one feature of the present invention each lead wire end connection 22 is provided with a fuse area 27 fastened in series intermediate the extremities thereof so as to be positioned in the lower segment of each subchannel 23 at a location remote from the outer pin segment 17 to reduce possible arcing mishaps in the event of fuse melt due to abnormally excessive current loads. It is to be noted that openings 14 and 16 in the upper segment 3 of terminal block 2 serve as open-ended access cavities to each include a cross-wall 28 on which is mounted a U-shaped clip 29 to which auxiliary electrical connections can be fastened.

Figure 4:
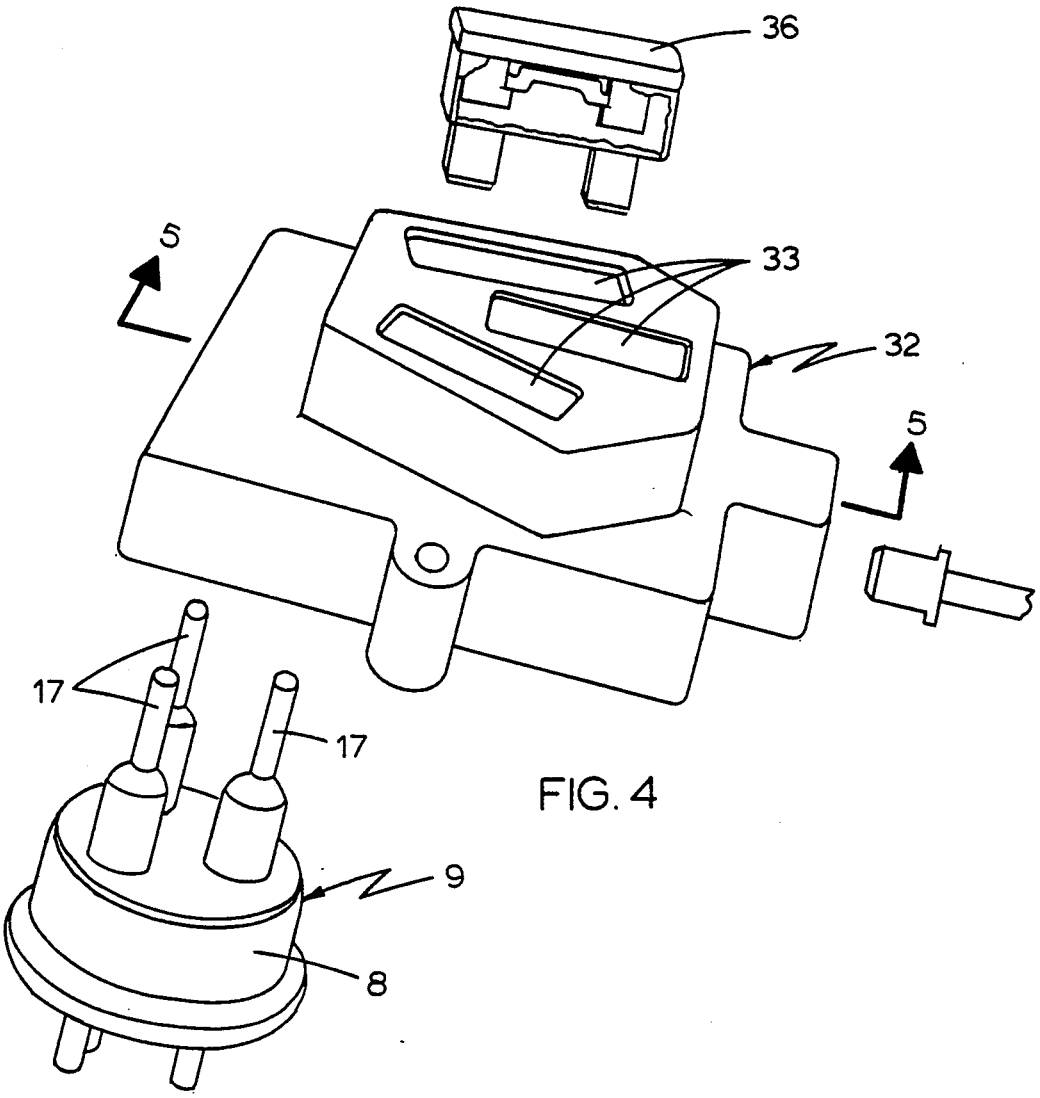
FIG. 4 is an exploded isometric schematic view of a modified embodiment of the inventive terminal block, further disclosing a hermetic terminal assembly with which it is to engage and one of the replaceable fuse members, partially broken away, in line with one of the fuse access openings in the disclosed terminal block.
Figure 5:
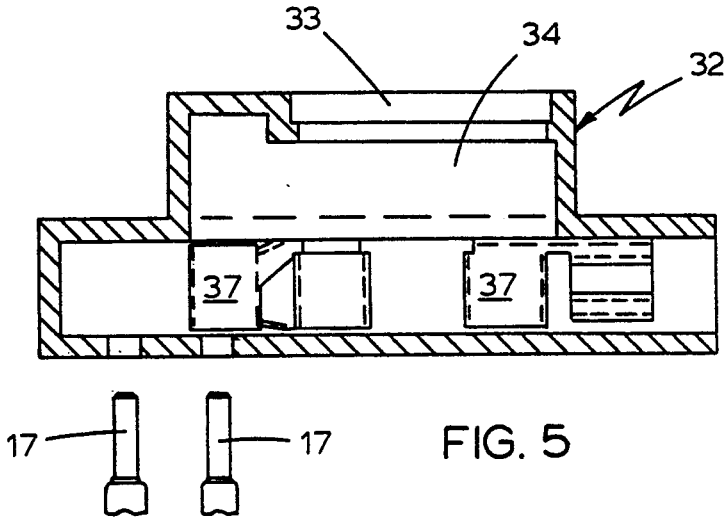
FIG. 5 is an enlarged schematic cross-sectional view taken in a plane through line 5—5 of FIG. 4, disclosing details of a fuse receptacle.

Referring to FIGS. 4 and 5 of the drawings there is schematically disclosed a modified terminal block 32 which is of slightly different configuration but which incorporates the double or stacked segment feature of terminal block 2. In this terminal block 32, the upper segments of the lateral subchannels extending from the outer pin receiving main channel are each provided with an access opening 33 on the outer face of the terminal block in communication with passage 34 leading to the stacked lower subchannel segment for insertion of a replaceable fuse 36 which engages in fast electrical connection between spaced electrical contacts 37 which are in series with a lead wire end connection, not shown in detail herein.

Figure 6:
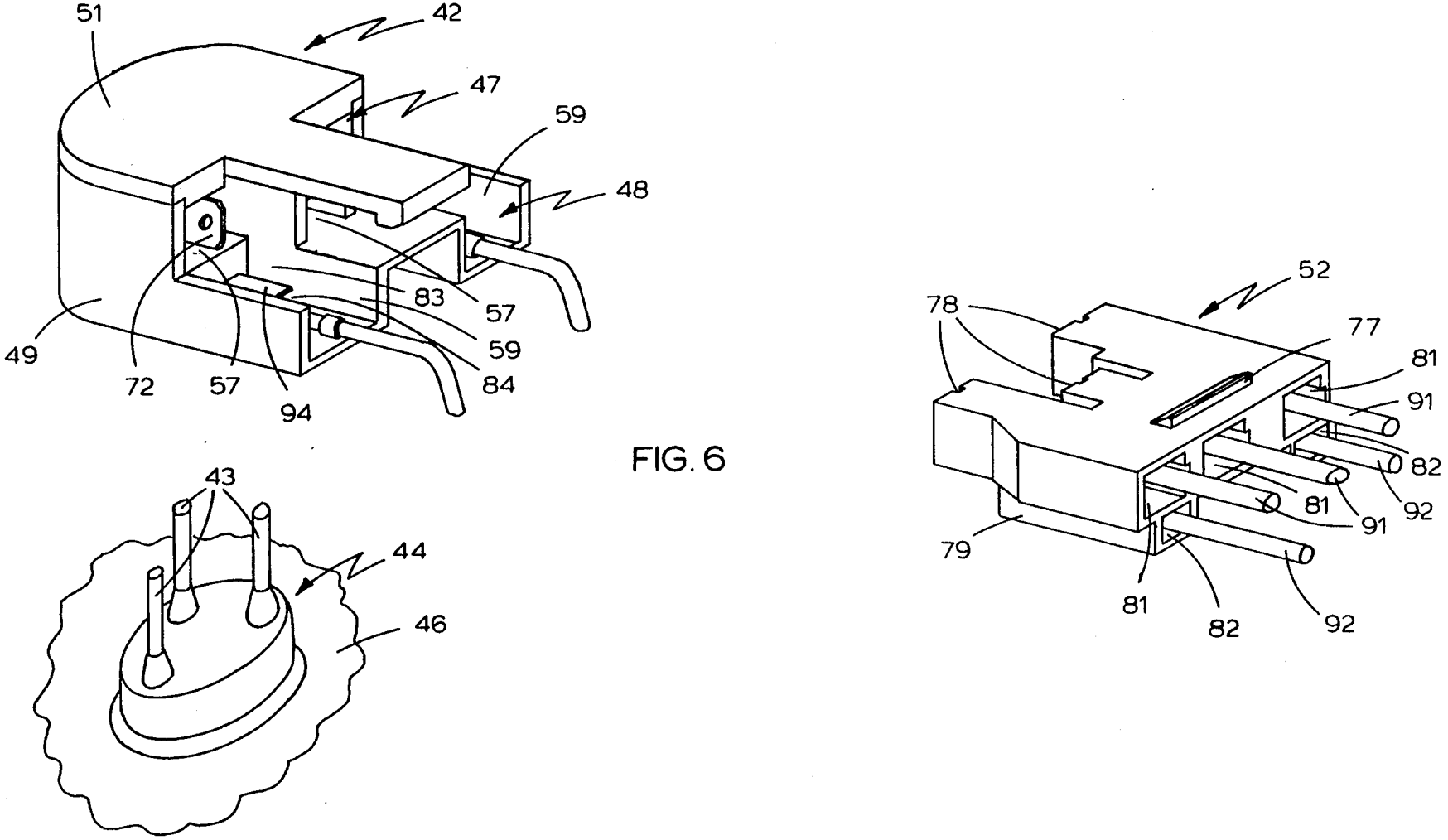
FIG. 6 is an exploded isometric view of a novel terminal block without a fuse device positioned in spaced relation above alignable engageable pin segments of a hermetic terminal assembly with a novel alignable and engageable power lead block positioned in spaced relation along one side of the terminal block disclosing power lead channel sets with electrical connectors disposed in the upper and lower tiers of the terminal block, and outside lead sets connected to the power lead block.
Figure 7:
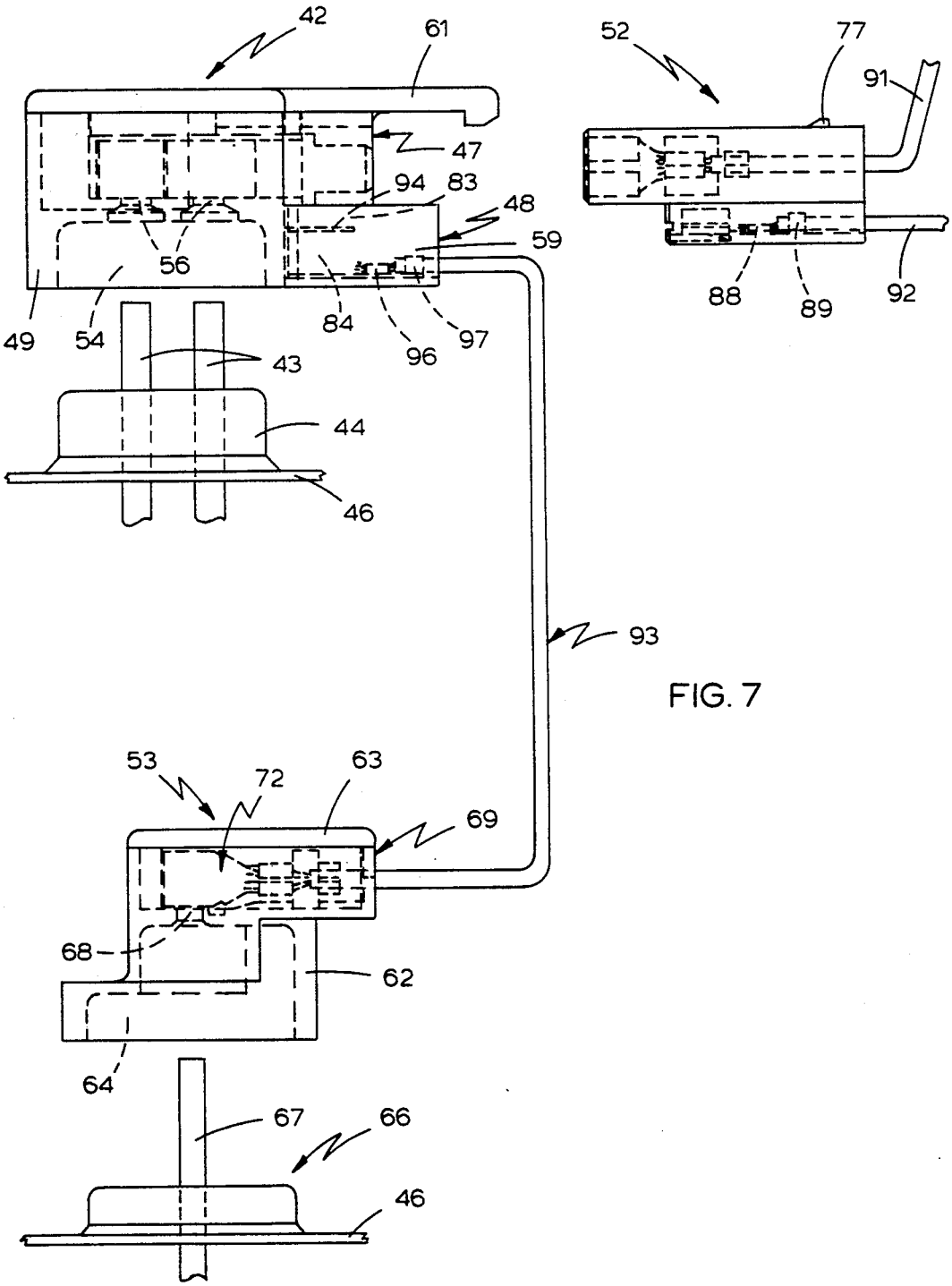
FIG. 7 is an exploded side view of the terminal block and power lead block structural arrangement of FIG. 6, further disclosing a second terminal block connected by a set of outside leads through the first terminal block positioned thereabove, the second terminal block being engageable with pin segments of another or second hermetic terminal assembly there below.

Referring to FIGS. 6 and 7, a novel interconnected terminal assembly in accordance with still another feature of the present invention and without a fuse device is disclosed to include a first terminal block 42 positioned above and in alignable engagement with three spaced outer pin segments 43 which are part of a first hermetic terminal assembly 44 mounted in compressor wall 46. Similar to the upper and lower block segments 3 and 4 of terminal 2, terminal block 42 is formed to include upper and lower tiers 47 and 48. Upper tier 47 and lower tier 48 can be and are here shown as formed from one body member 49 and, like terminal block 2, body 49 and cover 51 therefor can be made from any one of a number of appropriately specified current and heat resistive materials such as the above described General Electric Company Noral SE1 plastic or an equivalent current and heat resistive plastic or other material. Like terminal block 2, the geometric conformation of terminal block 42 including body 49 and cover 51 can vary in accordance with the hermetic terminal assembly and hermetically sealed housing wall to which it is to be mounted and, in addition, to the conformation of the power lead block 52 with which it is to interlockingly and electrically engage (described hereinafter) and the geometric construction of a second terminal block 53 (FIG. 7) to which it might also be electrically interconnected. The novel features of the power lead block 52 and the second terminal block 53, both of which can be formed from similar current and heat resistive plastic materials as first terminal block 42, will be described in more detail hereinafter.

As can be seen in FIGS. 6 and 7 and further in more detail in FIGS. 8–13, the first novel terminal block 42, includes a main body portion 49 and a cover 51 with main body portion 49 having a first main channel 54 which is adjacent to and insulated from lower tier 48. Main channel 54 is sized and configured to nestingly and snugly receive the body portion of first hermetic terminal assembly 44 mounted in compressor wall 46. The first main channel 54 is provided with three aperture openings 56 in one face of block 42 (only two of which can be seen in FIG. 7 of the drawings). These three openings 56 are sized and spaced to receive the three outer pin segments 43 of hermetic terminal assembly 44 when the main body of terminal assembly 44 nestingly engages in the first main channel 54 adjacent the insulated lower tier 48. It again is to be noted that main body 49 of terminal block 42 is so contoured that first main channel 54 is, in fact, electrically insulated from the lower tier 48 of main body 49 and that the outer pin segment 43 of hermetic terminal assembly 44 projects into communicative relation with upper tier 47 with the main body 49 acting as a diffuser in the event of terminal leakage. As can be seen in FIGS. 6 and 8 of the drawings, the communicatively connected upper tier 47 of main body 49 includes three spaced parallel open-ended subchannels 57 communicatively extending laterally from main channel 54 in spaced parallel relation. A first set of three power lead electrical connectors 58 are arranged to extend laterally from the first main channel 54 into the three communicatively connected spaced parallel subchannels 57 in the upper tier 47 of terminal block 42 with one power lead connector 58 extending into each subchannel 57. One end of each power lead electrical connector 58 is looped to extend and surroundingly engage in electrical contact with one of the three outer pin segments 43 extending into the upper tier of first main channel 54. The other end of each power lead electrical connector 58 extending into a communicating subchannel 57 is formed as a male spade which serves as part of a male-female electrical connection adjacent the open end of the upper tier subchannel 57 in which it is disposed. It is to be noted that advantageously each looped power lead connector 58 has a preselected electrical conductivity greater than the outer pin segment 43 with which it engages to allow appropriate fuse-like function which might otherwise be associated with a pin segment 43. As known in the art, each power lead electrical connector 58 can be of a suitable copper alloy material and can be provided with suitable peripheral tab members to engage in lineal slots in the subchannel 57 in which the connector 58 is disposed.

Referring particularly to FIG. 8–10 of the drawings which disclose top, side and end views of the first terminal block 42, it can be seen that the open ends of the outer positioned subchannels 57 in upper tier 47 of block 42 are lineally corresponding and are also lineally offset from the open end of the intermediate subchannel 57 which intermediate subchannel end extends laterally beyond the corresponding ends of the outer subchannels 57 from the upper tier of main channel 54 which houses outer pin segments 43. In the lower insulated tier 48 of the first terminal block 42 there are included two spaced lower subchannels 59 which extend in spaced parallel relation laterally below the upper outer subchannels 57 with the ends of lower tier subchannels 59 extending from main channel 54 beyond the three ends of upper tier outer and intermediate subchannels 57. The extending lower tier subchannels 59 are open at the top thereof so as to form subchannels of U-shaped cross-section. These U-shaped subchannels 59, as will be seen more fully hereinafter, are sized to receive a pair of spaced carriage subchannels; the U-shaped subchannels 59 serving as carriage subchannel guides and, in effect, are divided by the carriage channels into upper and lower subchannels compartments.

Referring to FIGS. 11–13, cover 51 for body 49 of the first terminal 42 is disclosed in detail. This cover 51 which serves to cover the first main channel 54 and the three spaced upper tier subchannels 57 laterally extending therefrom and in which looped end power lead electrical connectors 58 are disposed (as shown by the phantom lines in FIG. 11 of the drawings), is provided with an integral, flexible latching arm 61 which extends in cantilever fashion over and beyond intermediate upper tier subchannel 57. Cantilevering latching arm 61 is provided with a keeper engaging hook member 62 formed at the cantilevering end thereof to engage with a keeper member formed on engaging power lead block 52 (described hereinafter). It is to be understood that once looped connectors 58 are properly positioned in the upper tier subchannels 57 so that the looped ends thereof correspond with the three spaced aperture openings 56 through which outer pin segments 43 extend so as to be capable of electrically contacting such outer pin segments 43, the cover 51 can be appropriately fixed to body 49 by any one of several means—such as by fusion, by gluing, or by mechanical fasteners.

Figure 19:
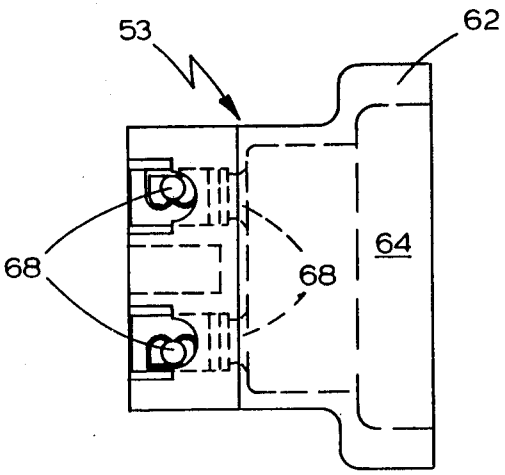
Figure 17:
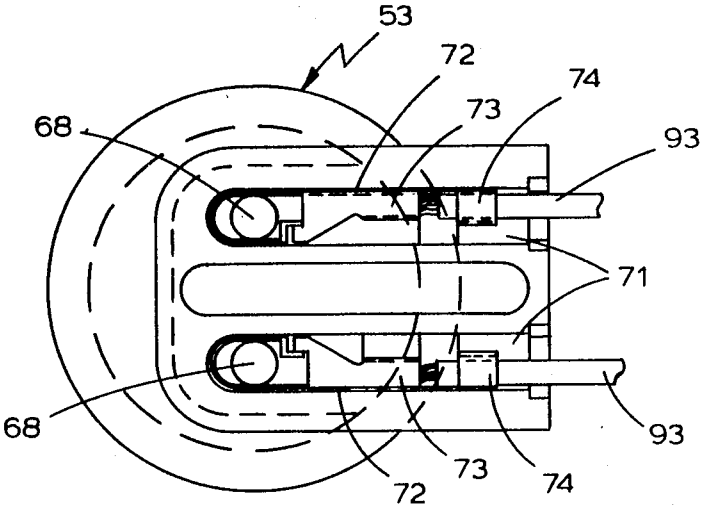
Figure 18:
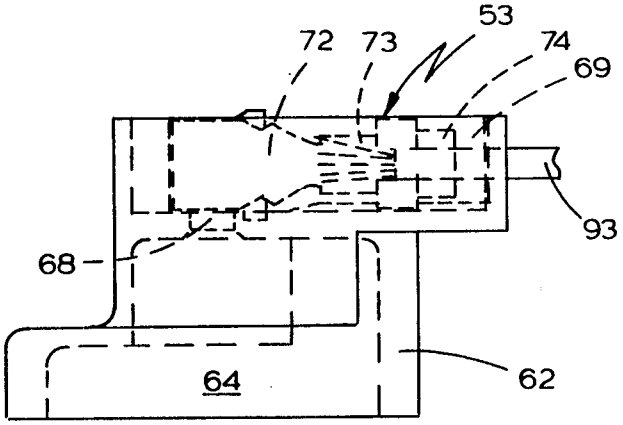

Referring to FIG. 7 which discloses a side view of second terminal block 53 electrically connected by a set of outside power leads to terminal block 42 and to FIGS. 17–19 which disclose top, side and end views respectively of second terminal block 53, it can be seen that second terminal block 53 includes a main body portion 62 and second cover 63 (FIG. 7) with second main body portion 62 having a second main channel 64 providing a lower tier sized and configured to nestingly and snugly receive the body portion of a second hermetic terminal assembly mounted in compressor wall 46—advantageously at the lower crank case heater portion thereof so as to provide electrical power to a heater element electrically connected thereto through a pair spaced outer pin segments 67, only one of which can be seen in FIG. 7 of the drawings (details of the inner pin segments and heater are not disclosed herein since the heater arrangement, itself, does not comprise a part of the present invention). The second main channel 64 is provided with two aperture openings 68 in one face of block 53 (also only one of which can be seen in FIG. 7 of the drawings 1). These two aperture openings 68 are sized and spaced to receive the two outer pin segments 67 when the main body 62 of second hermetic terminal assembly 53 nestingly engages in the second main channel or lower tier 64. The upper tier 69 of second main body 62 includes two spaced parallel open-end subchannels 71 communicatively extending laterally therefrom in spaced parallel relation. A second set of two power lead connectors 72 are arranged to extend laterally from the second main channel 64 into the two communicating parallel subchannels 71 in the upper tier 69 of second terminal block 53 with one power lead connector 72 of the second set of power lead connectors extending into each subchannel 71. One end of each power lead connector 72, like the first set of power lead connectors 58 above described, is looped to extend and surroundingly engage in electrical contact with one of the two outer pin segments 67 extending into the upper tier 69 of second main channel 64. The other end of each power lead connector 72 extending into subchannel 71 is provided with spaced integral ferrule tab pair 73 and 74 which serve to grip one end of a set of outside power leads, the pair of ferrule tabs 73 gripping the wire itself in electrical connection therewith and the pair of ferrule tabs 74 gripping the wire insulation. It is to be understood that looped power lead wire connectors 72 and the ferrule tab arrangement 73 and 74 can be part of any of several connectors known in the art to include suitable guide tabs projecting therefrom for nesting engagement with lineal slots provided in the open-end subchannels 71. It further is to be noted that the open ends of laterally extending parallel subchannels 71 housing power lead connectors 72 lineally correspond.

Figure 22:
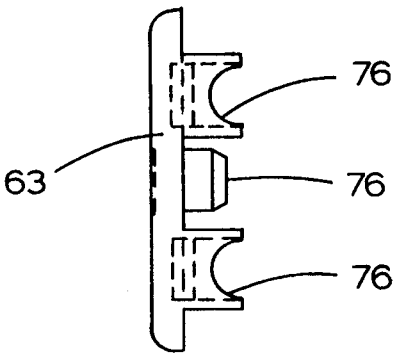
Figure 20:
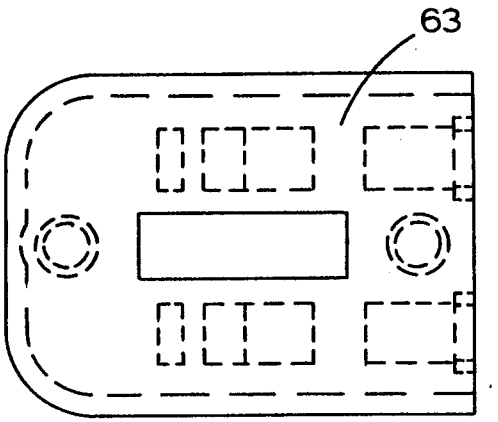
Figure 21:
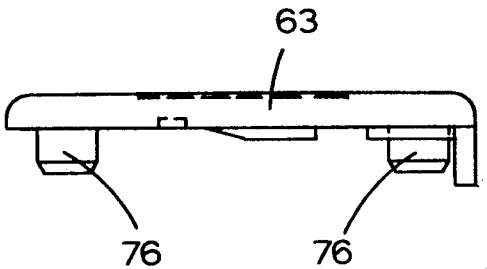

Referring to FIGS. 20–22, cover 63 for main body 62 of second terminal block 53 is disclosed in detail. This cover 63 which serves to cover the second main channel 64 and the two spaced upper tier subchannels 71 extending therefrom and in which looped end power lead electrical connectors 72 are disposed is arranged to include downwardly extending spaced posts 76 (FIG. 21) and is contoured and sized to engage main body 62 so as to cover main channel 64 and subchannels 71 containing power lead electrical connectors 72. Like cover 51, cover 63 can be appropriately fixed to its main body 62 by any one of several means-such as by fusion, by gluing or by mechanical fasteners.

Figure 14:
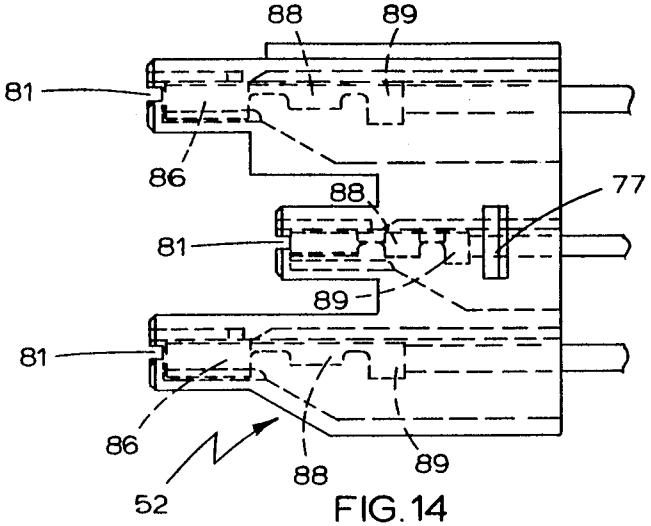
FIGS. 14–16 are top, side and end views respectively of the power lead block of FIGS. 6 and 7; and, FIGS. 17–19 and FIGS. 20–22 are somewhat enlarged top, side and end views respectively of the second terminal block body and cover therefore of FIG. 7, disclosing the other end of the outside lead set of FIG. 8 connected therewith.
Figure 16:
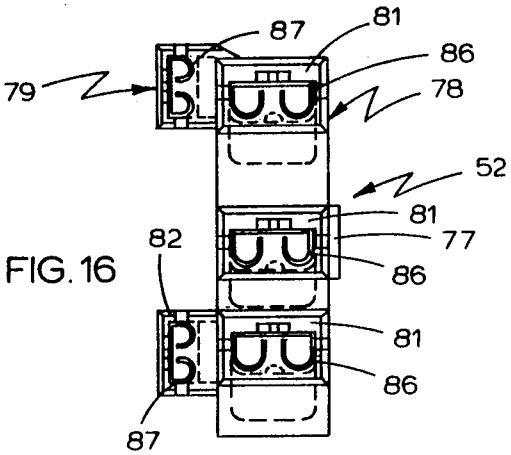
Figure 15:
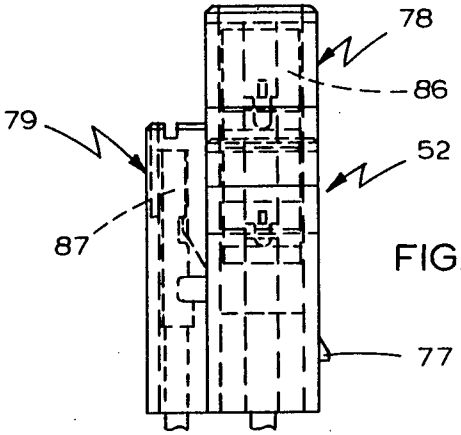

Referring to FIGS. 6 and 7 and to FIGS. 14–16, the novel interconnecting power lead block 52 is disclosed. As aforementioned, this block 52 can be of a current and heat resistive plastic material like the first and second terminal blocks 42 and 53 afore described. A ledge or keeper 77 is integral with the upper face of block 52, this keeper 77 being appropriately spaced and sized to engagingly receive and lock with the hooked end 62 of cantilevering latching arm 61 extending from the cove 63 of first terminal block 42 when blocks 42 and 53 are interlocked and the male-female connector parts are electrically engaged. As can be seen in the drawings, the power lead block 52 includes an upper channel tier set 78 and a lower channel tier set 79. The upper channel tier set 78 is comprised of three spaced channels 81 with corresponding ends of the two outer channels 81 of the upper channel tier set 78 at one end of power lead block 52 being lineally aligned to extend beyond the corresponding end of the intermediate channel 81 of tier set 78 a distance substantially equivalent to that which intermediate channel 57 of spaced channels 57 which comprises the upper tier set 47 of the first terminal block 42 lineally extends beyond the outer channels 57 of the upper tier set 47. The lower channel tier set 79 includes two spaced channels 82 which are positioned directly below the outer channels 81 of upper tier set 78. The corresponding ends of channels 82 of the lower channel tier set 79 at the same end of block 52 as above discussed are lineally aligned and proximate the corresponding end of the intermediate channel 81 of upper channel tier set 78. It is to be noted that each of the two channels 82 of the lower channel tier set 79 is sized to have a cross-sectional area approximately one half the cross-sectional area of the U-shaped carriage guide channels 59 of lower channel tier set of first terminal block 42. Thus, lower tier channels 82 of lower tier set 78 of power lead block 52 serve as carriage channels when the two novel blocks 42 and 52 are in interlocking engagement. In this regard, it is to be noted that the engaging ends of the upper and lower tier sets of the two blocks 42 and 52 are fashioned to be asymmetrically alignable and are so sized in relative cross-section to allow nesting interlocking end engagement. In the embodiment disclosed, the engaging ends of subchannels 57 and 59 in the upper and lower channel tier sets 47 and 48 respectively of first terminal block 42 are of slightly larger cross-sectional area than the nesting interlocking engaging ends of alignable channels 81 and 82 of the upper and lower tier sets 78 and 79 of power lead block 52. It further is to be noted and as above discussed that when spaced, alignable carriage rail channels 82 of the lower channel tier set 79 in block 52 engage with the carriage guide channels 59 of the lower channel tier set 48, carriage guide channels 59 of first terminal block 42, each of the carriage guide channels 59 being, in effect, divided into an upper channel compartment 83 and a lower channel compartment 84. It again is to be noted that these channel compartments 83 and 84, as compartments of guide channels 59 are insulated at adjacent corresponding ends thereof from first main channel 54.

Disposed within the three upper tier channels 81 and the two lower tier rail channels 82 of power lead block 52 are sets of upper and lower electrical connectors 86 and 87 respectively. These sets of electrical connectors 86 and 87 can be chosen from any one of several electrically conductive linear connectors known in the art with each including an appropriately sized female electrical connection part at one corresponding end thereof sized to receive a male spade electrical connection part of another electrical connector with which it nestingly engages when properly assembled. The other corresponding end of each electrical connector 86 and 87 of upper and lower channel tier sets 78 and 79 can each be provided with sets of spaced pairs 88 and 89 of wire connecting and insulation gripping spaced ferrule tabs with one pair of ferrule tabs 88 making electrical contact with the wire itself of an outside power line and the other pair of ferrules 89 gripping the insulation of such outside power line. In accordance with the present invention the corresponding female ends of electrical connectors 86 and 87, in the upper and lower channel tier sets 78 and 79 respectively of power lead block 52 are positioned to be asymmetrically aligned with and to nestingly engage in electrical contract with male spade ends of electrical connectors 72 and 94 (described hereinafter) disposed in the upper and lower subchannel tier sets 47 and 48 respectively of the first terminal block 42.

As can be seen in FIGS. 6–9, 14 and 13, suitable sets of outside power lines are provided to bring electrical power to power lead block 52 and ultimately to electrically connectable first terminal block 42 to be fastened to the three spaced outer pin segments 43 of first hermetic terminal assembly 44 which, in turn, is connected through hermetically sealed compressor wall 46 to a compressor (not shown) and to electrically connectable second terminal block 53 to be fastened to the two spaced outer pin segments 67 of second hermetic terminal assembly 66 which, in turn, is connected through hermetically sealed compressor wall 46 to a crankcase heater for such compressor (also not shown). Specifically, a first and second set of outside power lead lines 91 and 92 have their three and two power lines ends respectively electrically connected to the other lineally aligned and corresponding ferruled ends 88 and 89 of electrical connectors 86 and 87 respectively in power lead block 52. The other ends of the outside lead line sets 91 and 92 can be connected to a suitable preselected power source (not shown). A third set of outside power lead lines 93, including two power lines, have one of their corresponding ends electrically connected through ferrules 73 and 74 to electrical connectors 72 of the second terminal block 53. As above discussed, the other looped ends of electrical connectors 72 engage outer pin segments 67 of the second hermetic terminal 66.

In accordance with still another feature of the present invention, the other corresponding ends of outside power lead lines 93 are each provided with a novel U-shaped electrical connector 94 which electrical connector is sized to engage in one of the two spaced lower tier subchannels 59 of terminal block 42. These two spaced subchannels 59, as aforenoted, are appropriately insulated from the first main channel 54 of the first terminal block 42. The novel U-shaped electrical connectors 94 are arranged with appropriate tabs which are sized to engage in slots in the subchannels 59, the connectors 94 further having ferrule pairs 96 and 97 at one end of the lower leg thereof to be electrically connected to the other corresponding ends of the third set of outside power lead lines 93. Power lead lines 93 are connected at their opposite ends to the aforedescribed ferrule pairs 73 and 74 of electrical connectors 72 in second terminal block 53. Each of the U-shaped connectors 94 has the other upper leg spaced from the lower leg connected to a power lead line 92. In this regard, the base leg of each electrical connector 94 is so sized that the lower leg of connector 94 falls in lower subchannel compartment 84 and the upper leg falls in the upper subchannel compartment 83 when a U-shaped carriage guide subchannel 59 is divided into upper and lower subchannel compartments 83 and 84 respectively by engagement of lower tier carriage channels 79 of power lead block 52 with lower tier U-shaped carriage guide subchannels 59 of first terminal block 42, the carriage guide channel 59, in effect, providing upper subchannel compartment 83 for the upper leg of U-shaped electrical connector 94 and lower subchannel compartment 84 for the lower leg of electrical connector 94. It is to be noted that the end of the upper leg of each electrical connector 94 is adapted to nest with a female electrical connection at the end of a lower tier electrical connector 87 positioned in lower tier channel 84 of power lead block 52. Thus, when the two first and second terminal blocks 42 and 53 are readily connected in electrical contact with power lead block 52 appropriate electrical energy is delivered to hermetic terminal assembly 44 and to hermetic terminal assembly 66.

Thus, in accordance with the present invention a novel terminal block arrangement is provided which can be readily fastened in bonded relation to the outer pin segments of a hermetic terminal assembly sealed in an outside housing wall of a hermetically sealed compressor. This novel terminal block arrangement serves to protect the outer pin segments from ready access, diffuse possible leakage from the housing through the terminal assembly and to readily fuse the electrical system through secured lead wire connections at a location remote from the outer pin segments in the event of arcing. Further, a modified terminal block assembly arrangement is provided which allows for easy and ready connection of at least a first and second novel terminal block assembly to an electrically interconnected novel power lead block to further minimize some of the past safety problems which have arisen through amateur repair attempts.

The invention claimed is:

1. In combination with a hermetic terminal assembly having a body member sealed in a housing wall with said body member having protruding outer pin segments sealed thereto to extend from said body member externally of said housing wall, a first current and heat resistive terminal block, said first terminal block including a first main channel having aperture openings in one face of said block sized to engagingly receive and protect said outer pin segments and to act as a diffuser in the event of terminal assembly leakage, said first main channel having a first tier of spaced subchannels communicatively extending therefrom, first power lead electrical connectors disposed in said first tier of spaced subchannels, said first power lead electrical connectors each being fastenable at one end to one of said outer pin segments, each power lead connector having one part of male-female electrical connections at the opposite end; a current and heat resistive power lead block having a first tier of spaced channels alignable and co-operable with said first tier of spaced subchannels of said first terminal block, electrical connectors disposed in said first tier of channels of said power lead block, said electrical connectors each having the other part of male-female electrical connections at one end thereof nestingly engageable with said part of said male-female electrical connections at the end of said power lead electrical connectors in said first tier of subchannels in said first terminal block; and a first set of outside lead wires electrically connected at corresponding ends to the other ends of said electrical connectors in said first tier of channels in said power lead block and at the other ends to a power source.

2. The hermetic terminal assembly of claim 1, said first terminal block being sized and configured to be bonded into engaged position relative said housing wall.

3. The hermetic terminal assembly of claim 1, said first terminal block including a body portion and a cover portion and being sized and configured to abut said housing wall when in engaged position to be bonded in fast relation to said housing wall.

4. The hermetic terminal assembly of claim 1, said first tier of subchannels of said first terminal block communicatively extending in spaced parallel fashion laterally from said main channel, each spaced subchannel of said first tier of subchannels being sized to accommodate said male-female electrical connection end of one of said power lead connectors.

5. The hermetic terminal assembly of claim 1, said first current and heat resistive terminal block and said current and heat resistive power lead block including means to hold said two blocks in nesting engaged relation with each other to allow said male-female parts of electrical connectors in each of said two blocks to nestingly engage in electrical contact with each other.

6. The hermetic terminal assembly of claim 1, said first tier of spaced subchannels of said first terminal block including spaced subchannels longitudinally extending in parallel, lateral communicative fashion from said main channel and said first tier of spaced channels of said power lead block including a plurality of spaced channels aligned with said laterally extending subchannels of said first tier of subchannels of said first terminal block, said aligned channels and subchannels being relatively sized to nestingly engage at adjacent ends with the male-female electrical connections of said power lead electrical connectors and said first terminal block electrical connectors in said nesting aligned subchannels and channels respectively nestingly engaging in electrical contact.

7. The hermetic terminal assembly of claim 1, said first terminal block and said power lead block including latching means to hold said two blocks in nesting engaged relation with each other comprising a cantilevering arm extending from one block having a hooked portion at the free end thereof and a keeper on the other block to engagingly receive said hooked portion.

8. The hermetic terminal assembly of claim 7, said cantilevering arm being fixed to and extending from said first terminal block to engage with said keeper fixed to said power lead block.

9. The hermetic terminal assembly of claim 1, said hermetic terminal assembly including a second body member sealed in said housing wall with second protruding outer pin segments sealed thereto and extending from said second body member externally of said housing wall, a second current and heat resistive terminal block, said second terminal block including a second main channel having aperture openings in one face of said second terminal block sized to engagingly receive and protect said second outer pin segments within said second main channel and to act as a diffuser in the event of terminal assembly leakage, said second main channel having second spaced subchannels communicatively extending therefrom sized to accommodate second power lead electrical connectors fastenable at one end to said outer pin segments; and, another set of outside lead wires electrically connected at one end to the other end of said second set of power lead connectors with the other end of said another set of outside lead wires being connected to said power source.

10. The hermetic terminal assembly of claim 9, said first terminal block having a second tier of spaced subchannels insulated from said first main channel; a set of outside lead wire means having said second set of electrical connectors electrically connected at corresponding ends thereof to said other ends of said another set of outside lead wire; said set of electrical connectors connected to said another set of outside lead wires being engageable in said second tier of spaced subchannels of said first terminal block, said set of electrical connectors in said second tier of spaced subchannels of said first terminal block having the other ends connectable to still a further set of outside lead wires connected to said power source.

11. The terminal assembly of claim 10, said set of electrical connectors in said second tier of subchannels in said first terminal block having the other ends in the form of a part of male-female electrical connections said power lead block including a second tier of channels having electrical connectors with electrical connections at one of the ends thereof engageable with the male-female part of said electrical connectors in said second tier of said first terminal block, said electrical connectors in said second tier of said power lead block being engageable at the other of the ends thereof with said further set of outside lead wires.

12. The terminal assembly of claim 11, wherein said second set of electrical connectors disposed in said second tier of said first terminal block are of U-shaped configuration with said other said ends thereof forming part of said male-female electrical connections being in the form of male spades and said other part of said male-female electrical connections in said second tier set of electrical connectors in said power lead block being in the form of female receptor sheaths engageable therewith.

13. The hermetic terminal assembly of claim 1, said first terminal block including a second tier of spaced subchannels longitudinally extending in parallel, lateral fashion to provide upper and lower subchannel tier sets, each subchannel of each subchannel tier set being sized to accommodate one part of male-female electrical connections of electrical connectors at the end thereof with one of said upper and lower subchannel tier sets being connected through said power lead connectors to said pin segments in said main channel and the other of said tier sets being connectable through electrical connectors to an auxiliary electrical assembly.

14. The hermetic terminal assembly of claim 13, said power lead block including upper and lower channel tier sets, each channel tier set including electrical connectors having male-female lead wire end connections at the ends thereof with one channel tier set having its male-female lead wire end connections sized and positioned to nestingly engage with the male-female end connections of connectors of one tier set of said upper and lower tier sets of said subchannels of said first terminal block and the other channel tier set having its male-female end connections of connectors sized and positioned to nestingly engage with the male-female end connections of connectors in said other subchannel tier set of said first terminal block.

15. The hermetic terminal assembly of claim 14, said upper and lower subchannel tier sets of said first terminal block and said upper and lower channel tier sets of said power lead block being respectively alignable, said alignable channels and subchannels of both said upper and lower tier sets of said terminal block and said power lead block being relatively sized to nestingly engage at adjacent ends when aligned with the male-female connections in said nesting aligned subchannels and channels of said upper and lower tier sets nestingly engaging in electrical contact.

16. The hermetic terminal assembly of claim 15, said alignable upper tier sets of said first terminal block and said power lead block each including three spaced alignable subchannels and channels respectively with at least two adjacent corresponding subchannel ends in each upper tier set being linearly offset with respect to each other.

17. The hermetic terminal assembly of claim 16, said adjacent corresponding ends in each upper tier set of said first terminal block and said power lead block having non-adjacent outer subchannel ends linearly aligned.

18. The hermetic terminal assembly of claim 16, said alignable upper tier sets of said first terminal block and said power lead block being relatively asymmetrical to permit alignment of adjacent ends in only one manner.

19. The hermetic terminal assembly of claim 16, said alignable nesting lower tier sets of subchannels of said first terminal block and said channels of said power lead block each including two spaced alignable subchannels and channels respectively with adjacent corresponding ends in each lower tier set being alignable with one nesting lower tier set being sized of lesser cross-sectional area along the length thereof than the corresponding cross-sectional area of the other tier set so that nestingly engaging channels and subchannels of said lower tier sets divide the set of larger cross-sectional area each into two adjacent compartments of smaller cross-sectional area.

20. The hermetic terminal assembly of claim 19, wherein said set of larger cross-sectional area divided into said two adjacent compartments has one of said electrical connectors extending in one each of said adjacent two compartments to include one part of one of said electrical connections in one of said smaller cross-sectional area compartments and the other part of said electrical connections in the other adjacent smaller cross-sectional area compartments with one of the parts of said electrical connections in one of said divided adjacent smaller cross-sectional area compartments having an end in the form of said male-female electrical connection therein and said set of smaller cross sectional area compartments including the other part of said male-female electrical connections of said larger cross-sectional compartments aligned at one of the corresponding ends to provide engaging male-female electrical connections when said terminal block and said power lead block nestingly engage; and a second outside lead wire connected at one end to the other corresponding ends of said electrical connectors in said power terminal block with the other end of said second set of outside lead wires being connectable to a suitable power source.

21. The hermetic terminal assembly of claim 20 wherein said set of larger cross-sectional area is in said first terminal block to include subchannels of opened-top U-shaped cross-sectional configuration which provide guide subchannels to nestingly receive said set of lesser cross-sectional area in said power lead block to provide channel-like carriages nestingly engaging with said subchannels in said first terminal block to provide two adjacent subchannel compartments in superposed relation in each of said subchannels.

22. In combination with a hermetic terminal assembly having a body member sealed in a housing wall with said body member having a plurality of protruding outer pin segments sealed to said body member and extending from said body member externally of said housing wall, a current and heat resistive terminal block, said terminal block including a main channel having a plurality of aperture openings in one face of said block sized to engagingly receive and protect said spaced outer pin segments and to act as a diffuser in the event of terminal assembly leakage, said main channel having spaced subchannels communicatively extending therefrom; power lead electrical connectors disposed in said subchannels, each being fastenable at one end to one of said outer pin segments with the other end of each of said power lead connectors serving to form one part of an electrical connection to be engaged by electrical connection located externally of said terminal block.

23. The current and heat resistive terminal block of claim 22, said outer pin segments including three outer spaced pin segments and said aperture openings in one face of said terminal block including three spaced apertures aligned and sized to engage and nestingly to receive said three spaced outer pins segments.

24. The current and heat resistive terminal block of claim 22, said outer pin segments including two spaced outer pin segments and said aperture openings in one face of said terminal block including two spaced apertures aligned and sized to engage and nestingly receive said two spaced outer pin segments.

25. The current and heat resistive terminal block of claim 22, said terminal block including a main body portion having an open face opposite said face having aperture openings therein; and, a cover plate sized and contoured to cover and be fastened to said main body.

26. The current and heat resistive terminal block of claim 22, said terminal block having a cantilevering latch member with a hooked end extending therefrom to firmly engage a keeper of another structural member to which said terminal block is to be fastened.

27. The current and heat resistive terminal block of claim 26, said terminal block being of a molded plastic material.

28. The current and heat resistive terminal block of claim 22, said power lead electrical connectors each including a loop at one end thereof sized to surround one of said aperture openings to electrically contact a pin segment when engaged in said aperture opening.

29. The current and heat resistive terminal block of claim 22, said subchannels of said terminal block including a plurality of spaced subchannels longitudinally extending in lateral, parallel fashion as upper and lower subchannel tier sets, the subchannels of one subchannel tier set being communicative with said main channel and the other subchannels of said other tier set being insulated from said main channel, said channels of said main channel communicative set being sized to accommodate the other ends of said power lead wire connectors, a set of electrical connectors disposed in said other subchannel tier set, with the electrical connectors in both tier sets having one part of a male-female lead wire connection at one of the ends thereof connectable to a power source with the electrical connectors in the one tier set insulated from said main channel, each having its other end connectable to an auxiliary electrical assembly.

30. The current and heat resistive terminal block of claim 29, said upper subchannel tier set of said terminal block including three spaced subchannels with at least two adjacent corresponding subchannel ends in said upper tier set being lineally offset with respect to each other.

31. The current and heat resistive terminal block of claim 29, said upper subchannel tier set of said terminal block including three spaced subchannels comprised of two outer and one intermediate subchannels with the two outer non-adjacent subchannels having corresponding ends lineally aligned and the end of the intermediate subchannel lineally offset from the ends of said outer subchannels.

32. The current and heat resistive terminal block of claim 29, said lower subchannel tier set including two spaced subchannels insulatively blocked off at one of the corresponding ends thereof from said main channel and having opposite corresponding ends thereof lineally extending outwardly from the corresponding ends of said upper tier of subchannels.

33. The current and heat resistive terminal block of claim 32, said spaced lower tier subchannels being of U-shaped cross-section to be open at the top to form carriage channel guides to receive carriage channels of an auxiliary assembly which interfits therewith and which divides each of said lower tier subchannels into upper and lower compartments.

34. The current and heat resistive terminal block of claim 33, said electrical connectors to be disposed in said lower tier subchannels each being turned upon itself so that one leg extends into an upper compartment and the opposite leg extends into a lower compartment when said carriage channels of an auxiliary assembly is interfitted therewith to divide each of said subchannels into said upper and lower compartments.

35. A current and heat resistive power lead block having spaced open-ended channels linearly alignable and intermeshably engageable with linearly aligned open-ended channel-like members of an external structure, electrical connectors disposed in said spaced channels of said power lead block, each electrical connector in said power lead block having part of a male-female electrical connection disposed at a corresponding end thereof linearly engageable through aligned open ends with the other part of said male-female electrical connection at the end of an electrical connector in said external structure, each of said electrical connectors in said power lead block having the other end connected to one end of an outside lead wire electrically connected at the opposite end to a power sources.

36. The current and heat resistive power lead block of claim 35, said power lead block including a keeper member externally mounted thereon spaced and sized to receive a hooked end of a cantilevered latch member extending from said external structure to maintain said external structure in intermeshed and aligned firm linearly aligned and intermeshed engagement therewith.

37. The current and heat resistive power lead block of claim 35, said linearly alignable spaced channels thereof being arranged in upper and lower channel tier sets with each channel in both sets having one of said electrical connectors disposed therein.

38. The current and heat resistive power lead block of claim 37, said upper channel tier set of said power lead block including three spaced channels with at least two adjacent corresponding channel ends in said upper channel tier set being lineally offset with respect to each other.

39. The current and heat resistive power lead block of claim 37, said power lead block including a keeper member externally mounted thereon spaced and conformed to receive a hooked end of a latch member extending from said external structure to maintain said external structure in intermeshed and aligned firm engagement therewith.

40. The current and heat resistive power lead block of claim 37, said upper channel tier set of said power lead block including three spaced channels comprised of two outer and one intermediate channel with the two outer non-adjacent channels having corresponding ends lineally aligned and the end of the inter-mediate channel lineally offset from the ends of adjacent outer channels.

41. The current and heat resistive power lead block of claim 37, said lower channel tier set including at least two spaced channels sized and alignably positionable to serve as carriage channels to engage with carriage guide channels in said external structure.

42. The current and heat resistive power lead block of claim 37, said upper channel tier set of said power lead block including three spaced channels comprised of two outer and one inter-mediate channel and said lower channel tier set including two spaced channels with each of said two channels of said lower channel tier set being positioned immediately below said outer channels of said upper channel tier set, with corresponding ends of the two outer channels of the upper channel tier set being linearly aligned and the corresponding ends of the upper inter-mediate channel and the two spaced channels of the lower tier set being linearly offset from the ends of said outer channels of said upper tier set, said two spaced channels of said lower tier set being sized and positioned to serve as carriage channels to engage with alignable carriage guide channels in said external structure so as to divide said carriage guide channels into an upper and lower compartment structure.

43. A current and heat resistive electrical block assembly comprising two open ended channel members extending co-extensively in substantially parallel relation to provide two communicatively connectable and separately coextensive compartments in said block assembly wherein said coextensive parallel channels of said electrical block assembly are each part of separate unitary block structures which separate structures are adjustably assembled in interlocking relationship and, an electrical connector turned upon itself to form a U-shape integral configuration with one leg thereof extending in one communicatively connectable compartment and the other leg extending in the other compartment with opposite ends each serving as part of an integral electrical connection.

44. The current and heat resistive electrical block assembly of claim 43, wherein the electrical connection at least at one end of one leg of said electrical connector is part of a male-female electrical connection.

45. The current and heat resistive electrical block assembly of claim 43, wherein the electrical connection at at least one end of one leg of said electrical connector is configured to have a power lead line electrically fastened thereto.

46. The current and heat resistive electrical assembly of claim 43, wherein the electrical connection at one end of one leg of said electrical connector is part of a male-female electrical connection and the electrical connection at the opposite end of said other leg is configured to have a power line electrically fastened thereto.

47. An improved electrical connection assembly including an electrical connector clip and open-ended communicably connectable and separately adjacent coextensive channels in a block assembly comprising:

an electrically conductive elongated integral shank member having ferrule pairs at one end thereof for gripping an insulated lead wire to be connected thereto at one end of one of said adjacent coextensive channels; said integral shank member being turned upon itself to form a U-shaped configuration to allow the other end to extend into said other coextensive channel, said other end being fashioned as part of a male-female electrical connection.

48. The electrical connection assembly of claim 47, said ferrule pairs of said shank member including two spaced pairs of opposed laterally extending ears, one pair of which serves to be crimped about the insulation of said insulated lead wire and the other pair of which serves to grip the wire itself.

49. The connector clip of claim 47, said male-female electrical connection being in the form of a male spade and a female connector nestable therewith.

50. An electrical connector clip for mounting in open ended adjacent coextensive channels of a block assembly comprising:

an electrically conductive elongated shank member having ferrule pairs at one end thereof for gripping an insulated lead wire to be connected thereto at one end of one said adjacent channels, said ferrule pairs including two spaced pairs of mirror-image opposed laterally extending ears, one pair of which serves to be crimped about the insulation of said insulated lead wire and the other pair of which serves to grip the wire itself;

said shank member being turned upon itself to form a U-shaped configuration to allow the other end to extend into said other channel, said other end being in the form a male spade to engage with a female connection end of an external structure.

51. In combination with a hermetic terminal assembly for a compressor having two spaced body members sealed in the compressor housing wall, each with protruding outer pin segments sealed to said body member and extending from said body member externally of said compressor wall with the pin segments connected to the compressor including three pin segments and the other of the pin segments connected to a crank case heater for the compressor including two pin segments, a current and heat resistive block assembly comprising: three electrically interconnectable plastic blocks, the first of which serves as a compressor terminal block, the second of which serves as a crankcase heater block and the third of which serves as an interconnecting power lead block comprising, said first current and heat resistive plastic terminal block serving as a compressor block including a first main body portion and a cover portion therefor with said main body portion having a first main channel with three aperture openings in one face of said first terminal block sized and spaced to engagingly receive and protect said three outer pin segments within said first main channel and to act as a diffuser in the event of first terminal block leakage, said first main channel having a spaced, parallel open ended upper tier set of three subchannels communicatively extending there from in spaced parallel lateral fashion, a first set of three power lead electrical connectors extending from said first main channel into said three subchannels of said upper tier set, one end of each of said first set of power lead electrical connectors being looped to extend and engage in electrical contact therewith one of said three outer pin segments and the other end of each power lead electrical connector extending into one of said upper tier subchannels being formed as the male spade part of a male-female electrical connection adjacent the open end of said upper tier subchannel in which it is disposed with said outside ends of said outside subchannels being linearly corresponding and linearly offset from the end of said intermediate subchannel in said upper tier of subchannels with said intermediate subchannel linearly from said first main channel extending beyond said outer subchannels, said lower tier of subchannels including two spaced subchannels extending linearly below and beyond said outer subchannels of said upper tier of spaced subchannels with the extending portions being open at the top to form subchannels of U-shaped cross-section capable of receiving and serving as a pair of carriage receiving guide subchannels, said cover portion conforming with said upper tier of subchannels and having an integral, flexible, latching arm cantilevered therefrom with a keeper engaging hook formed at the cantilevered end there of;

said second current and heat resistive plastic block serving as a crankcase heater block including a second main channel with two aperture openings in the face of said crankcase heater block sized and spaced to engagingly receive and protect said two outer pin segments within said second main channel means and to act as a diffuser in the event of second terminal block leakage, said second main channel having a spaced pair of two subchannels communicatively extending there from in spaced parallel lateral fashion; a second set of two power lead electrical connectors extending from said second main channel into said two subchannels, one end of each of said second set of power lead electrical connectors being looped to extend and engage in electrical contact therewith one of said two outer pin segments and the other end of each of said second set of power lead electrical connectors extending into one of said two subchannels of said second terminal block being formed as an electrical connection to receive the end of a set of outside lead wires;

said third plastic block which serves as an interconnecting power lead block including a keeper member mounted thereon spaced and sized to receive said hooked end of said latch member cantilevering from said cover of said first terminal block, said power lead block including upper and lower channel tier sets said upper channel tier set comprised of three spaced channels with corresponding ends of the two outer channels of said upper tier set at one end of said power lead block being linearly aligned to extend beyond said corresponding end of said intermediate channel at one end of said power lead block, said lower channel tier set including two spaced channels directly below said outer channels of said upper tier set with corresponding ends at said one end of said lead block being linearly aligned and proximate said end of said intermediate channel of said upper tier set, said two channels of said lower tier set being approximately one half the cross-sectional area of said two subchannels of said lower tier set of said first terminal block to serves a carriage channels with adjacent ends of said upper and lower tier set subchannels of said first terminal block and said upper and lower tier set channels of said power lead block being relatively sized and being asymmetrical to nestingly engage with said lower tier carriage channels of said power lead block dividing said lower tier subchannels of said terminal block into upper and lower subchannel compartments; each of said three upper tier channels and said two lower tier channels in said power lead block having an electrical connector disposed therein with corresponding ends of each of said electrical connectors in said power lead block having female connections engageable with male spade connections disposed and disposable in said upper and lower subchannel tier sets of said terminal block; first and second sets of power lines having corresponding ends electrically connected to said opposite ends of said electrically connectors in said upper and lower channel tiers of said power lead block; and a third set of power lead lines having one of the corresponding ends connected to said other corresponding ends of said second power lead connectors in said second terminal block; and a set of U-shaped electrical connectors sized to engage in said upper and lower subchannel compartments formed by said engaging lower tier guide subchannels of said first terminal block and said lower tier carriage channels of said power lead block with one leg of each U-shaped electrical connector extending in said lower subchannel compartment with its end electrically fastened to the opposite end of one of said third set of power lead lines and the other leg extending in said upper compartment having its end fashioned as a male spade to engage with a female end of an electrical connector in one of said lower tier channels serving as a carriage for said power lead block.

* * * * *